US008789724B2

(12) United States Patent
Roncari

(10) Patent No.: US 8,789,724 B2
(45) Date of Patent: Jul. 29, 2014

(54) PRODUCT VENDING MACHINE TRAY

(75) Inventor: Aristide Domenico Roncari, Paderno Dugnano (IT)

(73) Assignee: N & W Global Vending S.p.A., Valbrembo (IT)

( * ) Notice: Subject to any disclaimer, the term of this patent is extended or adjusted under 35 U.S.C. 154(b) by 403 days.

(21) Appl. No.: 13/255,860

(22) PCT Filed: Mar. 10, 2010

(86) PCT No.: PCT/IB2010/000499

§ 371 (c)(1),
(2), (4) Date: Mar. 20, 2012

(87) PCT Pub. No.: WO2010/103379

PCT Pub. Date: Sep. 16, 2010

(65) Prior Publication Data

US 2012/0168344 A1 Jul. 5, 2012

(30) Foreign Application Priority Data

Mar. 11, 2009 (IT) ..... TO2009A0180
Nov. 17, 2009 (IT) ..... TO2009A0880

(51) Int. Cl.
*G07F 11/16* (2006.01)

(52) U.S. Cl.
USPC ..... 221/251; 221/277; 221/311

(58) Field of Classification Search
USPC ..... 221/75, 251, 277, 311
See application file for complete search history.

(56) References Cited

U.S. PATENT DOCUMENTS 3,828,971 A * 8/1974 Offutt et al. ..... 221/75
3,840,147 A * 10/1974 O'Neal et al. ..... 221/75
4,240,563 A * 12/1980 Lennartson ..... 221/75
6,520,373 B1 * 2/2003 Neely et al. ..... 221/75

FOREIGN PATENT DOCUMENTS

BE 422127 A 7/1937
WO WO 01/29788 A2 4/2001
WO WO 2004/006195 A2 1/2004

* cited by examiner

*Primary Examiner* — Timothy Waggoner
(74) *Attorney, Agent, or Firm* — Dickstein Shapiro LLP

(57) ABSTRACT

A tray for product vending machines, the tray having at least one channel with an outlet; a conveying device extending along the channel to support a column of products and feed the products to the outlet; and a release device for selectively allowing the products through the outlet, and having an independent passive retaining member, which extends across the channel to intercept a top portion of the first product in the column, and is moved by the first product from a normal withdrawn position to a forward position, in which the passive retaining member is located at least partly past the outlet in the travelling direction of the conveying device.

9 Claims, 5 Drawing Sheets

3
5a
4
4
1
6
13
14
15
12a
12b
15
2
19
2
20
19
17
11
8
21
18
17
18
16
16
7
10
5
9

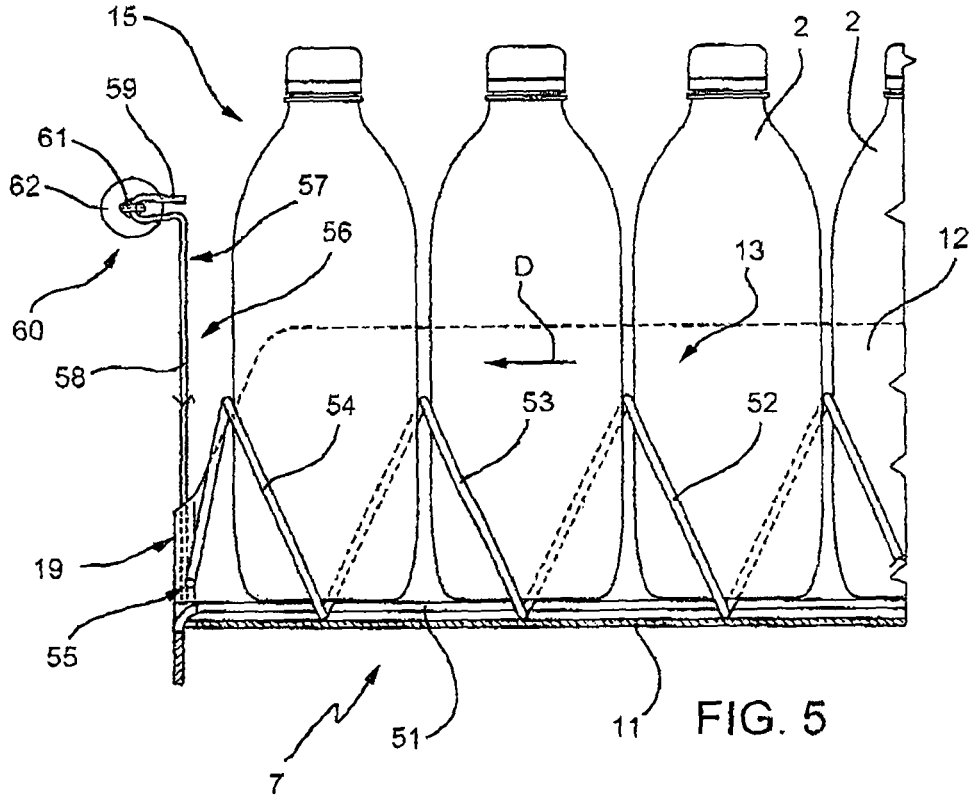
FIG. 5
FIG. 6
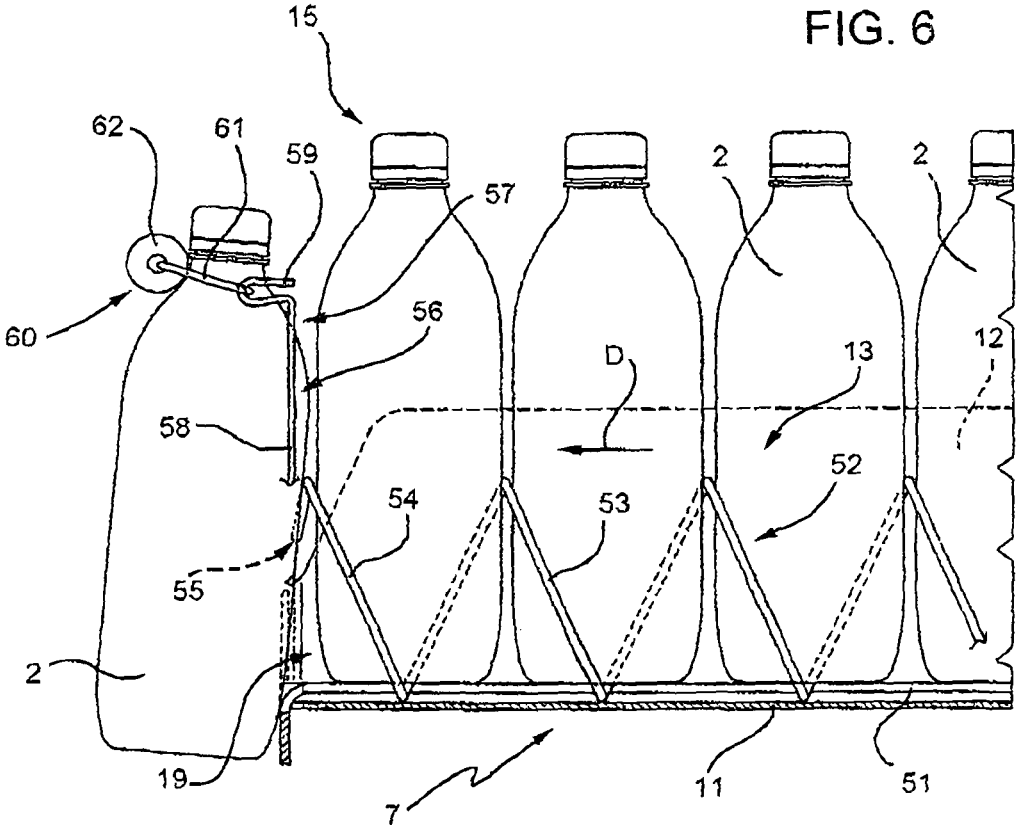

PRODUCT VENDING MACHINE TRAY

TECHNICAL FIELD

The present invention relates to a product vending machine tray.

More specifically, the present invention relates to a product vending machine tray of the type comprising at least one channel with an outlet, the channel being designed to house a column of products, and housing conveying means for feeding the products successively to and through the outlet in a substantially straight travelling direction; and a release device for allowing the products successively through the outlet; the release device comprising stop means and retaining means independent of each other and located at the outlet.

BACKGROUND ART

Product vending machines are known to comprise a cabinet or similar container defining a space, which is bounded laterally by two lateral walls, is closed at the front by a door, and houses a number of fixed, superimposed trays of the type described above, which extend between the lateral walls to support respective numbers of products, such as bottles or cans. The trays occupy a rear portion of the space, so as to define, between the door and the front ends of the trays facing the door, a drop shaft communicating with a take-out bin normally located at the bottom of the cabinet.

A drawback of vending machines of the above type employing trays of the type described is that the products, as they are fed forward by the relative conveying means in a straight line through the outlet of the relative channel into the drop shaft, tend to tilt forward towards the door, before dropping vertically into the shaft. As a result, they are not only damaged by striking the door, but, in the worst case scenario, which occurs when the products are as tall as the distance between the trays and the door, fall across the shaft and jam between the door and the end of the tray, thus preventing the product from being expelled, and also impairing subsequent operation of the machine.

The above drawback is partially solved by vending machines such as those disclosed, for example, in BE-422127 and WO-01/29788.

DISCLOSURE OF INVENTION

It is an object of the present invention to provide a product vending machine tray of the above type, designed to eliminate the above drawbacks completely.

According to the present invention, there is provided a product vending machine tray as claimed in claim 1 and preferably in any one of the following claims depending directly or indirectly on claim 1.

BRIEF DESCRIPTION OF THE DRAWINGS

A number of non-limiting embodiments of the present invention will be described by way of example with reference to the accompanying drawings, in which:

FIGS. 5 and 6 show side views of a detail of the FIG. 4 tray in two different operating configurations.

BEST MODE FOR CARRYING OUT THE INVENTION

Figure 1:
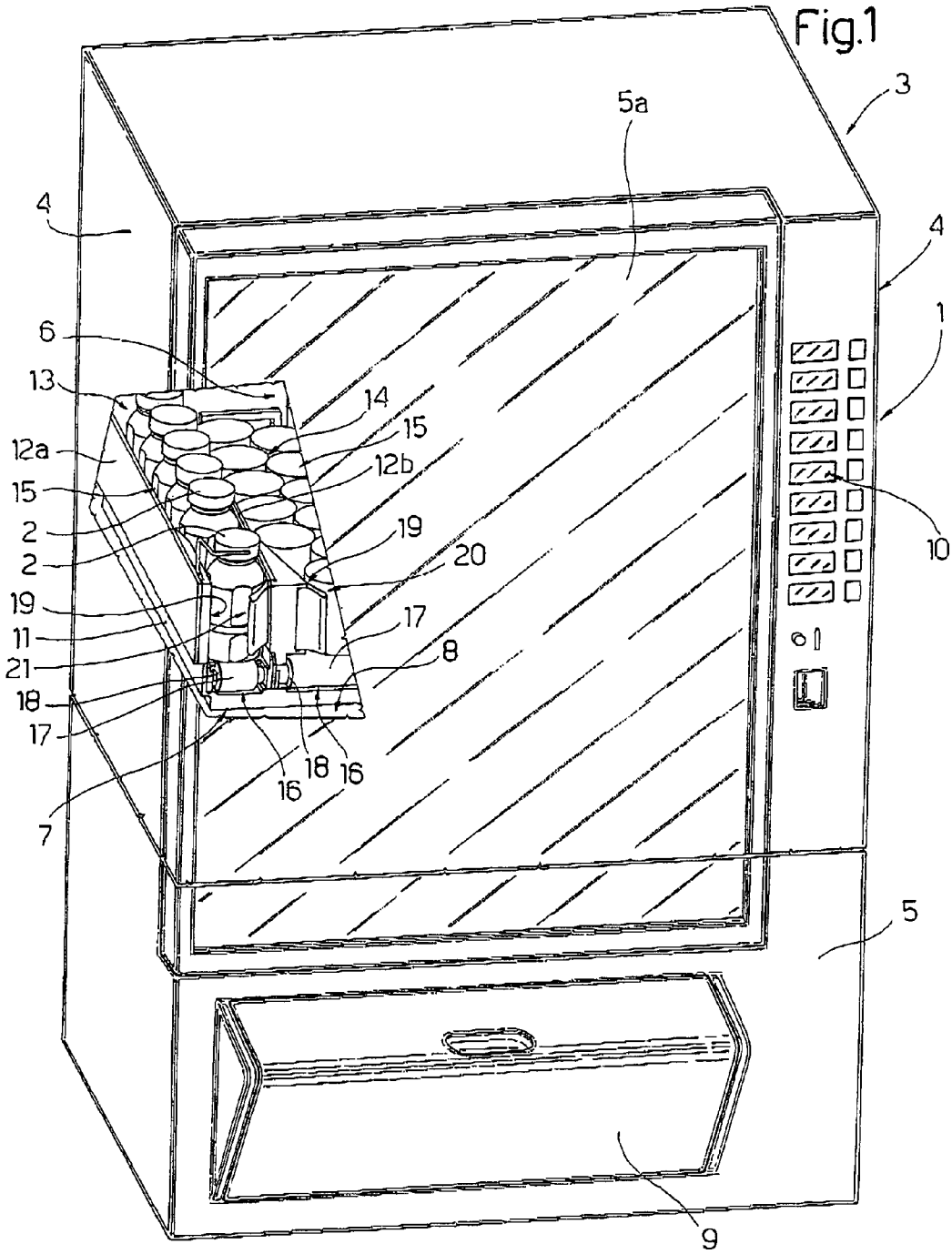
FIG. 1 shows a schematic view in perspective of a vending machine featuring a first preferred embodiment of the tray according to the present invention.

Number 1 in FIG. 1 indicates as a whole a vending machine for products 2, comprising a cabinet 3 having two lateral walls 4, and a front wall 5 defined partly by a door 5*a* and which, together with lateral walls 4, defines an inner space 6.

Inside space 6, machine 1 houses a number of trays (only one shown in FIG. 1) arranged one over the other, facing door 5*a*, and which support products 2, extend between lateral walls 4 in respective substantially horizontal planes crosswise to lateral walls 4 and front wall 5, and occupy a rear portion of space 6, so as to define, between door 5*a* and the respective front ends of the trays facing door 5*a*, a drop shaft 8 communicating with a take-out bin 9 fitted to front wall 5, below door 5*a*, and from which to withdraw from the outside a product 2 selected on a pushbutton panel 10 on front wall 5 and dispensed from one of trays 7.

With reference to FIG. 1, each tray 7 comprises a frame defined by a base 11 lying in a substantially horizontal plane; and by a number of walls or partitions (only two, indicated 12*a* and 12*b*, are shown) which are perpendicular to base 11 and front wall 5, and divide tray 7 into a number of channels (indicated 13 or 14, depending on their width) which extend perpendicular to front wall 5 and house products 2—in the example shown, bottles and cans—arranged in columns 15 perpendicular to front wall 5.

More specifically, each channel 13 (only one shown) only houses one column 15, whereas each channel 14 (only one shown) houses two parallel, offset columns 15.

The bottom wall of each channel 13, 14 is defined by a respective powered conveyor 16 comprising a belt 17 looped about two rollers 18 (only one shown), which are located at the ends of relative channel 13, 14, extend crosswise to partitions 12, and define on belt 17 a top branch for supporting and conveying relative products 2.

Each conveyor 16 feeds relative products 2 in a substantially straight travelling direction D (FIGS. 2, 3) towards door 5*a* and to and through an opening or outlet 19 through which relative channel 13, 14 communicates with drop shaft 8. Outlet 19 of each channel 14 is controlled by a respective known release device 20 for selectively releasing products 2; and outlet 19 of each channel 13 is controlled by a respective release device 21, described below, for selectively releasing products 2. When relative conveyor is activated, each release device 20, 21 is activated, in use, to allow only one product 2 at a time to drop into shaft 8.

The channel 13 shown is located, by way of example, along a lateral end of tray 7 adjacent to a lateral wall 4.

In the example shown, partition 12*a* of the channel 13 shown is located adjacent to said lateral wall 4, and partition 12*b* separates channel 13 from an adjacent channel—in the example shown, a channel 14.

As shown in the attached drawings, release device 21 associated with channel 13 comprises a passive member (described below) and an active member, which are located on opposite sides of conveyor 16 at outlet 19, and are mechanically independent of each other. The active member is a stop member comprising a flap 23, which is activated by a respective known actuating device (not shown) connected to a central control unit (not shown), and is defined by a curved member positioned with its concavity facing inwards of channel 13, and hinged centrally to partition 12*b* to rotate, about a respective axis 24 perpendicular to base 11, between a closed position (FIG. 1), in which flap 23 partly closes relative outlet 19 to prevent the forward movement of products 2 by relative conveyor 16, and an open position (FIG. 2), in which flap 23 allows the first product 2 in relative column 15 through outlet 19, while a rear portion 25, extending towards the centre of channel 13, of flap 23 holds back the rest of column 15.

Figure 3:
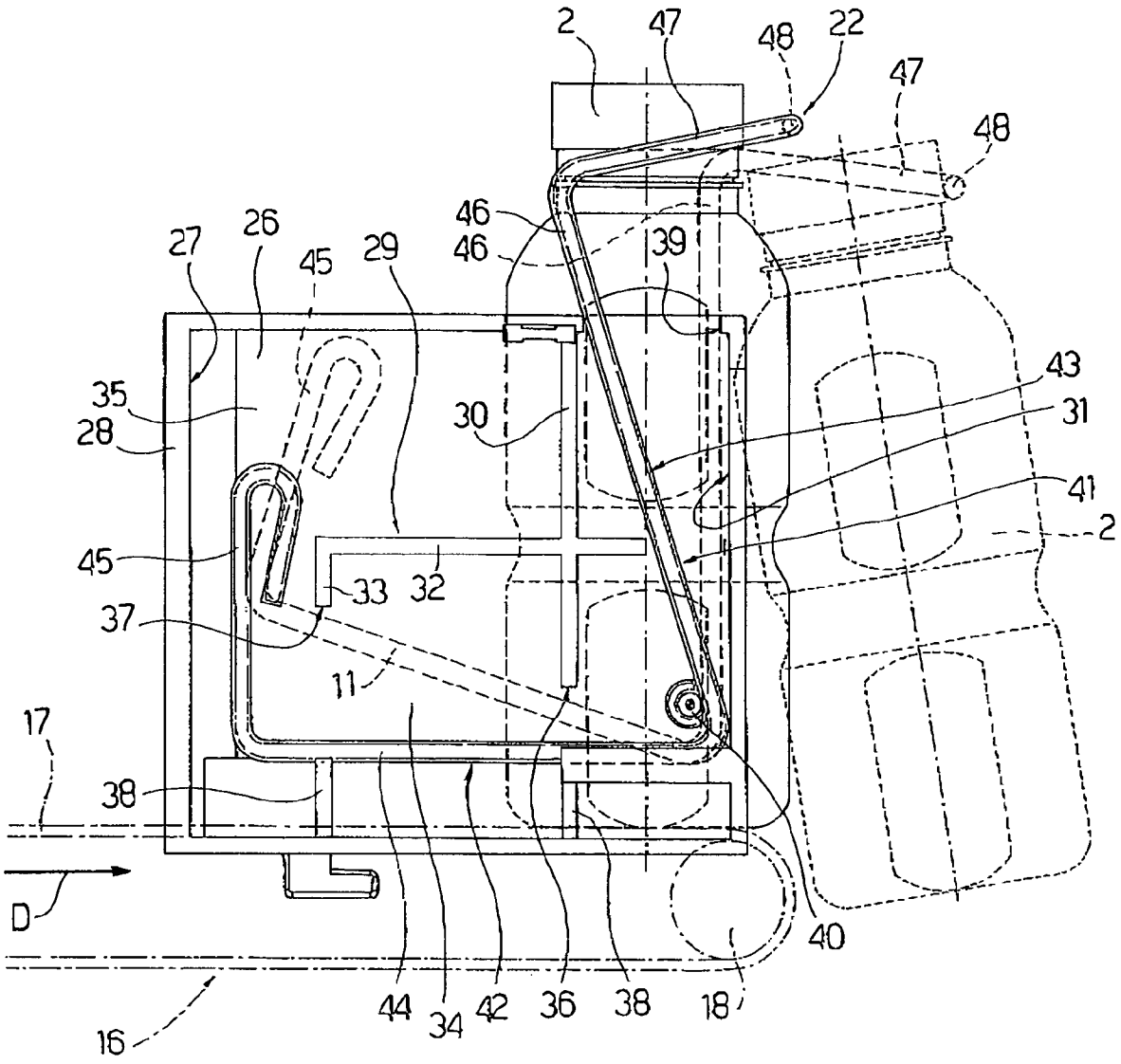
FIG. 3 shows a side view of the FIG. 2 detail.

As shown more clearly in FIG. 3, passive member 22 is fitted to partition 12*a*, and comprises a movable member, and a fixed member supporting the movable member. The fixed member is defined by a plate 26, which is fitted to the surface of partition 12*a* facing partition 12*b*, and defines, with partition 12*a*, a substantially rectangular chamber 27. Chamber 27 is bounded externally by a rim 28 forming part of plate 26, and is divided internally into a number of portions by inner ribs 29 also forming part of plate 26.

Ribs 29 are substantially in the form of an h turned rearwards of tray 7, and comprise a vertical branch 30 extending the full height of chamber 27 and defining, with a front vertical portion of rim 28, a substantially rectangular front portion 31 of chamber 27. Ribs 29 also comprise a horizontal branch 32 extending rearwards from a mid-point along branch 30; and a further vertical branch 33, which extends downwards from the free rear end of branch 32, defines a rectangular bottom rear portion 34 of chamber 27 with a horizontal bottom portion of rim 28 and a bottom portion of branch 30, and defines an L-shaped rear portion 35 of chamber 27 with a horizontal top portion and a vertical rear portion of rim 28.

Portions 31, 34, 35 communicate via a window 36 formed through the bottom portion of branch 30, and via a window 37 larger than window 36 and formed through branch 33. Windows 36 and 37 have respective bottom edges at the same distance from the horizontal bottom portion of rim 28, so as to define, in the bottom portion of branch 30 and in branch 33, respective supports 38 of equal height and extending vertically upwards from the horizontal bottom portion of rim 28. Portion 31 communicates externally at the top through a window 39 formed through the horizontal top portion of rim 28; and chamber 27 is fitted through with a pin 40, which is located substantially at outlet 19, is perpendicular to partitions 12, is located close to a front bottom corner of portion 31, and is positioned facing window 36 on one side, and a front end of window 39 on the other.

The movable member of release device 21 is defined by a rocker arm 41, preferably made of bent wire or a bent metal rod, which lies in a vertical plane parallel to partitions 12 and travelling direction D, and is housed partly inside chamber 27. Rocker arm 41 extends about pin 40 to oscillate about the axis of pin 40, and comprises a bottom arm 42 housed inside chamber 27 and extending through windows 36 and 37; and a top arm 43 extending through window 39.

As shown in FIG. 3, bottom arm 42 is L-shaped, and comprises two portions 44 and 45 substantially perpendicular to each other; portion 44 extends rearwards from pin 40 and through windows 36 and 37; and portion 45 is housed inside portion 35, and extends upwards from the rear end of portion 44. Top arm 43 is an L-shaped lever arm, and comprises two portions 46 and 47 substantially perpendicular to each other; portion 46 extends upwards from pin 40 and through window 39, and forms an angle of less than 90° with portion 44; and portion 47 is located outside chamber 27, above the top edge of partition 12*a*, and extends forwards, in travelling direction D, from the top end of portion 46.

Figure 2:
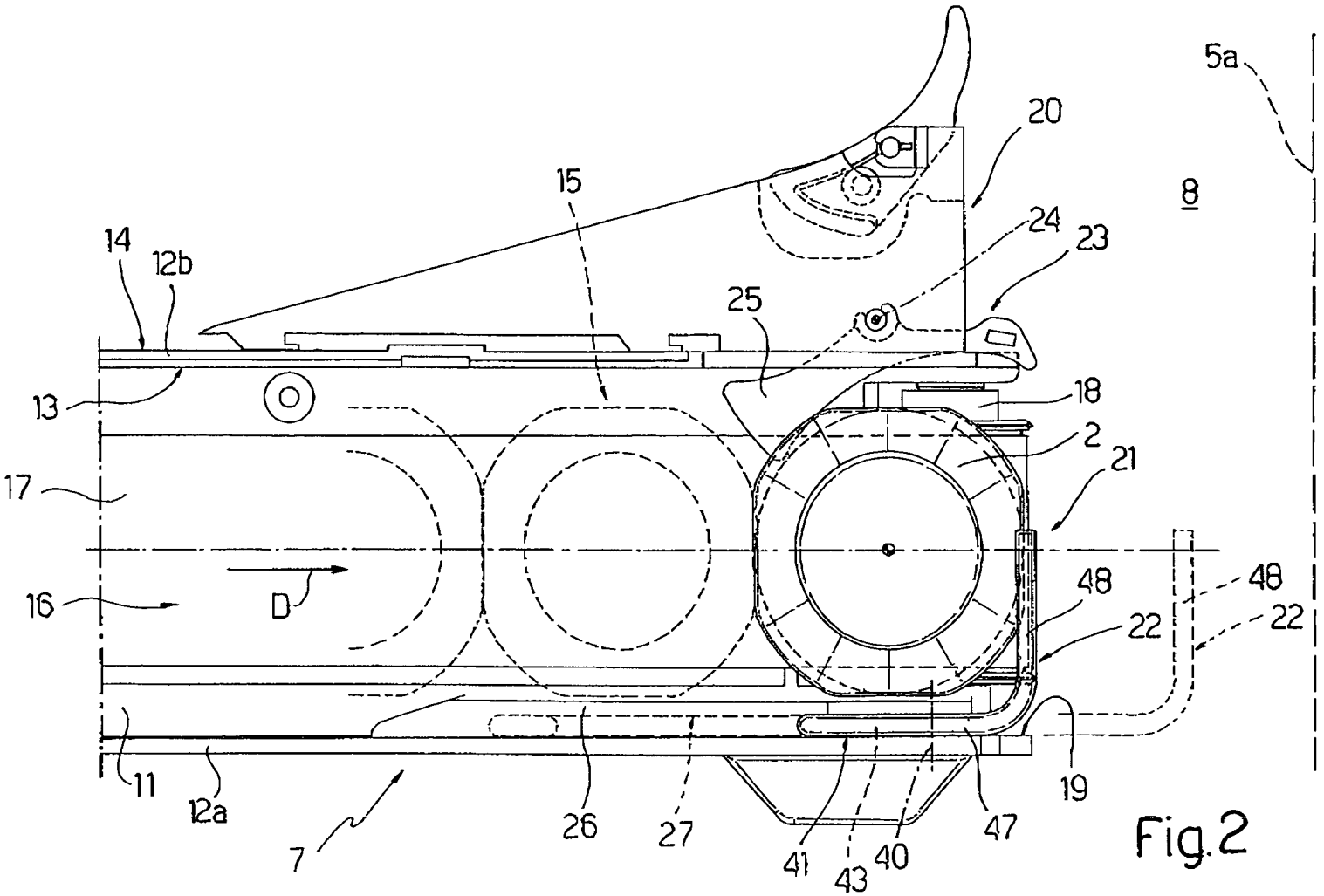
FIG. 2 shows a larger-scale plan view of a detail in FIG. 1.

As shown more clearly in FIG. 2, top arm 43 is bent further to define a retaining member 48, which is located above the top edge of partition 12*a* and extends, parallel to pin 40, across relative outlet 19 towards flap 23, from the top end of portion 46.

Rocker arm 41 is movable between a withdrawn rest position (shown by the continuous line in FIG. 3), in which portion 44 of bottom arm 42 rests on the top ends of supports 38, and portion 46 of top arm 43 slopes rearwards and substantially contacts the rear end of window 39; and a forward work position, in which portion 44 of bottom arm 42 is raised off supports 38, and portion 46 of top arm 43 is substantially vertical and positioned contacting the front end of window 39.

When rocker arm 41 is in the withdrawn rest position, retaining member 48 is located directly over the front end of conveyor 16, and therefore inside channel 13 and in front of any one of products 2 still fully supported on conveyor 16 and located immediately downstream from flap 23 in the open position.

When rocker arm 41 is in the forward work position, retaining member 48 is located inside drop shaft 8, and is projected, in the plane of conveyor 16, to a distance from the front edge of conveyor 16 substantially equal to the length of portion 47 of top arm 43.

In connection with the above, it should be pointed out that the withdrawn rest position described of rocker arm 41 is one of stable equilibrium, in that, whatever the position of rocker arm 41 within its oscillation range about pin 40, gravitational forces always restore it to its rest position resting on the top ends of supports 38.

Obviously, the same result can also be achieved, for example, by eliminating bottom arm 42, hinging top arm 43 directly to pin 40, and inserting a pull spring between top arm 43 and the rear of plate 26.

In actual use, when the user selects a product 2 from channel 13, conveyor 16 is activated to move the relative column 15 towards relative outlet 19, thus pressing the first product 2 against flap 23 in the closed position. Next, flap 23 is opened in known manner, by operating an actuator (not shown), and moved into the FIG. 2 position, i.e. allowing the first product 2 to move forward freely, and holding back the other products 2 in column 15.

Once past flap 23, and before being expelled completely from outlet 19, a top portion of first product 2 comes into contact with retaining member 48, which is pushed forward and swings rocker arm 41 about pin 40 into the forward work position.

Top arm 43 of rocker arm 41 comes to a stop against the front end of window 39, thus stopping retaining member 48 and the top portion of product 2 engaged by retaining member 48. The bottom part of product 2, on the other hand, keeps moving forward in travelling direction D on conveyor 16, so that product 2 firsts tilts backwards, and then (FIG. 3) drops straight off conveyor 16 and out from under retaining member 48, which moves automatically back into the withdrawn rest position.

In other words, in addition to retaining member 48 of rocker arm 41 preventing product 2 from tilting forward towards door 5*a*, portion 47 of top arm 43 also retains product 2 laterally, to prevent it, as it falls, from being tilted towards partition 12*a* by the lateral thrust exerted by flap 23.

Figure 4:
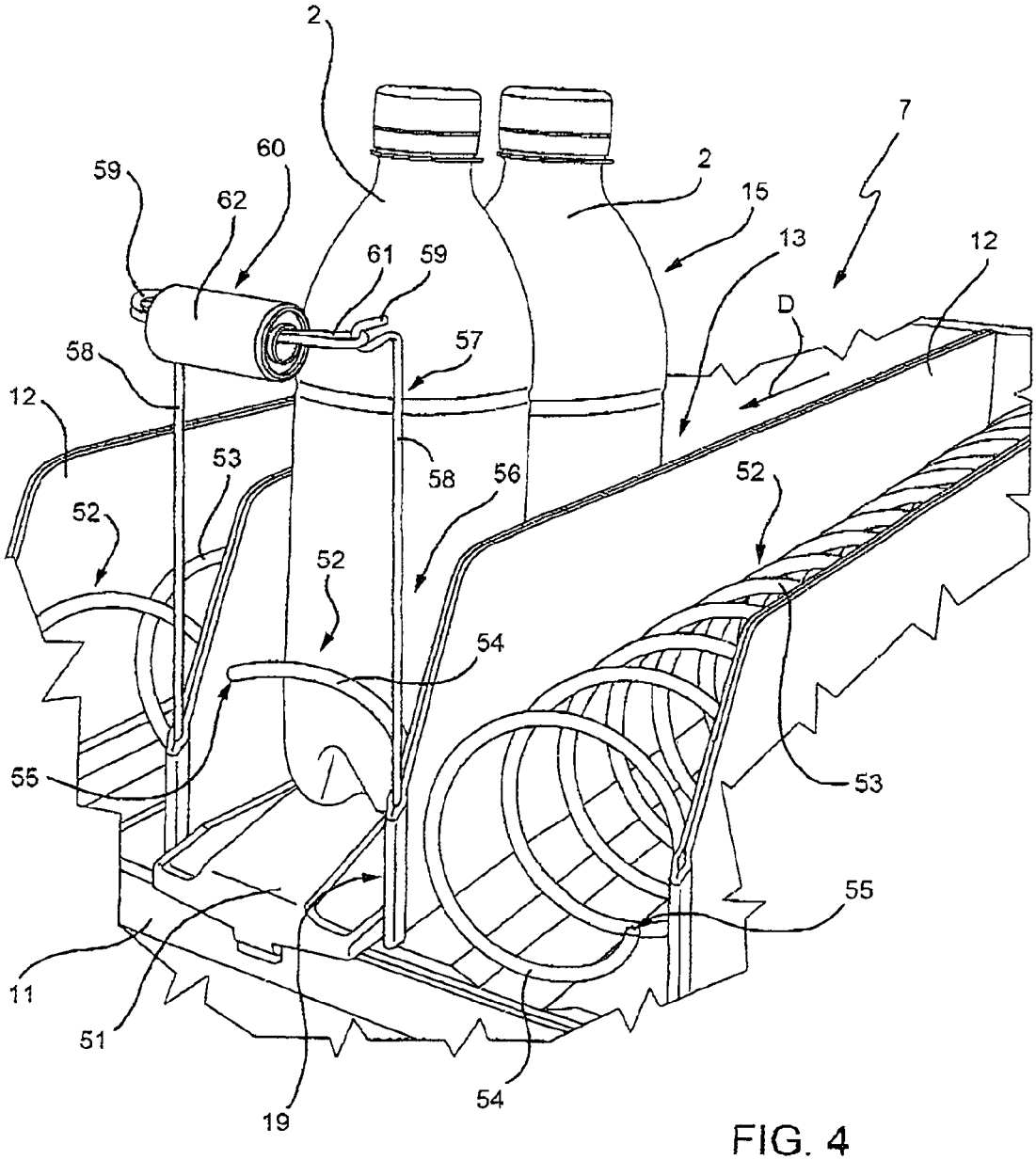
FIG. 4 shows a partial view in perspective of a second preferred embodiment of the tray according to the present invention.

The FIG. 4-6 embodiment relates to a tray 7, in which base 11 supports a number of partitions 12 dividing tray 7 into a number of channels 13, each for housing one column 15 of products 2—in the example shown, bottles or cans.

The bottom wall of each channel 13 is defined by a track 51, which extends under a respective powered conveyor 52 comprising, in known manner, a cylindrical metal coil 53. Coil 53 extends along relative channel 13, and comprises a number of turns, each adjacent pair of which defines a slot for a respective product 2, which is fed gradually forward in direction D to relative outlet 19 as coil 53 rotates about its axis. Coil 53 comprises an end turn 54 located at relative outlet 19 and having a free end 55, which, for each 360° rotation of coil 53, moves across outlet 19 to first allow the first product 2 in column 15 to move up to outlet 19, and then close relative channel 13 to hold back the products 2 behind the first.

In other words, end turn 54 defines an active stop member forming part of a release device 56 for selectively releasing products 2. Release device 56 allows one product 2 at a time to drop into shaft 8, and also comprises a passive member 57 mechanically independent of the relative active member, i.e. end turn 54.

Passive member 57 is a gate-type member fitted to relative partitions 12 at relative outlet 19, and comprises a movable portion, and a fixed portion supporting the movable portion. The fixed portion is defined by two uprights 58, each of which is defined by a rod extending upwards from a mid-point of respective partition 12, is connected integrally at the bottom to respective partition 12, and has a top hook 59 located above the top edges of partitions 12, and at a height off relative track 51 lower than the height of relative products 2. The movable portion is defined by an elastic crosspiece 60 extending substantially horizontally between hooks 59 and crosswise to direction D, and comprising an elastic member 61 connecting hooks 59 of relative uprights 58; and a tubular body 62 located at outlet 19 and fitted in sliding manner to elastic member 61.

In actual use, when the user selects a product 2 from a channel 13, coil 53 of relative powered conveyor 52 is activated to move the relative column 15 towards relative outlet 19. During this movement, and as the free end 55 of end turn 54 moves crosswise to channel 13 in the plane of outlet 19, thus gradually opening outlet 19, the first product 2 is pushed gradually past the end of relative channel 13.

Before being expelled completely from outlet 19, a top portion of first product 2 comes into contact with tubular body 62, which is pushed forward in direction D and by deformation of elastic member 61 from a withdrawn rest position, which is an undeformed position of stable equilibrium, to a forward position, in which tubular body 62 is located at least partly outside outlet 19.

When deformation of elastic member 61 ceases, tubular body 62 stops, thus stopping the top portion of first product 2. The bottom portion of first product 2, however, keeps moving forward, pushed by coil 53, in direction D, so that first product 2 first tilts backwards, and then drops off the end of track 51 and from under crosspiece 60, which springback of elastic member 61 automatically restores to the withdrawn rest position clear of drop shaft 8.

The invention claimed is:

1. A tray for product vending machines, the tray comprising:

at least one channel having an outlet and two lateral walls, and housing a column of products;

conveying means for feeding the products successively to and through the outlet; and a release device for allowing the products successively through the outlet comprising stop means and retaining means independent of each other;

wherein the conveying means is designed to feed the products successively to and through the outlet in a straight travelling direction;

wherein the stop means is located, together with the retaining means, at the outlet, and activatable to move between a position at least partly closing the outlet, and a position opening the outlet to release a first product in the column;

wherein the retaining means comprises a fixed portion and a movable portion, which is supported by the fixed portion and extends across the channel to intercept a top portion of the first product; and wherein the movable portion is elastically deformable between a withdrawn position, in which the movable portion is located at the outlet and inside the channel, and a forward position, in which the movable portion is located at least partly past the outlet in the travelling direction.

2. A tray as claimed in claim 1, wherein the retaining means are passive, and are moved by the first product into the forward position.

3. A tray as claimed in claim 1, wherein the withdrawn position of the retaining means is a normal position of stable equilibrium.

4. A tray as claimed in claim 1, wherein the conveying means comprise a coil conveyor extending along the channel and having a succession of turns, wherein each pair of adjacent turns houses a respective product in the column; the coil conveyor incorporating the stop means, being activated to feed the products to the outlet in the traveling direction, and having a free end turn located at the outlet and defining the stop means.

5. A tray as claimed in claim 4, wherein the stop means are defined by an end turn of the coil conveyor.

6. A tray as claimed in claim 1, wherein the retaining means comprise a gate-type member, which is fitted to the respective lateral walls at the respective outlet; the fixed portion comprising two uprights, each extending upwards from the respective lateral wall and having a top end; and the movable portion comprising an elastically deformable crosspiece connecting the top ends of the uprights together.

7. A tray as claimed in claim 6, wherein the crosspiece extends substantially horizontally between the top ends of the uprights and crosswise to the traveling direction, and comprises an elastic member connecting said top ends; and a tubular body fitted to the elastic member and movable through the outlet by deformation of the elastic member.

8. A product vending machine comprising a tray as claimed in claim 1.

9. A tray as claimed in Claim 6, wherein the movable portion Comprises an elastic member.

* * * * *